US005578276A

United States Patent [19]

Klobucar

[11] Patent Number: 5,578,276

[45] Date of Patent: Nov. 26, 1996

[54] REGENERATIVE THERMAL OXIDIZER WITH TWO HEAT EXCHANGERS

[75] Inventor: Joseph M. Klobucar, Plymouth, Mich.

[73] Assignee: Durr Industries, Inc., Plymouth, Mich.

[21] Appl. No.: 392,187

[22] Filed: Feb. 22, 1995

[51] Int. Cl.[6] ..... F01N 3/10

[52] U.S. Cl. ..... 422/173; 432/181; 422/175; 431/170

[58] Field of Search ..... 431/11, 164, 170; 432/180, 181; 422/173, 175

[56] References Cited

U.S. PATENT DOCUMENTS

| | | | |
|---|---|---|---|
| 1,222,690 | 4/1917 | Smythe . | |
| 3,870,474 | 3/1975 | Houston | 432/180 |
| 4,943,231 | 7/1990 | Jenkins et al. | 431/215 |
| 5,092,767 | 3/1992 | Dehlsen | 432/181 |
| 5,145,363 | 9/1992 | Nielsen et al. | 432/180 |
| 5,161,968 | 11/1992 | Nutcher et al. | 432/179 |
| 5,184,951 | 2/1993 | Nutcher et al. | 432/28 |
| 5,240,403 | 8/1993 | McAnespie | 431/5 |
| 5,304,059 | 4/1994 | Tanaka et al. | 431/170 |
| 5,346,393 | 9/1994 | D'Souza | 432/179 |
| 5,460,789 | 10/1995 | Wilhelm | 431/170 |

OTHER PUBLICATIONS

PCT Application WO91/00477 Jan. 1, 1991.

*Primary Examiner*—Carroll B. Dority
*Attorney, Agent, or Firm*—Howard & Howard

[57] ABSTRACT

A unique purge system for a two heat exchanger RTO system uses separate purge valves associated with each of the first and second heat exchangers. In this way, the purge valves allow strict control over the flow of clean gas through the purge valves and into the heat exchanger. The inventive system insures that the two RTO systems can continue to operate efficiently and safely, while insuring that no dirty gas will reach the outlet passages.

9 Claims, 6 Drawing Sheets

REGENERATIVE THERMAL OXIDIZER WITH TWO HEAT EXCHANGERS

BACKGROUND OF THE INVENTION

This application relates to a regenerative thermal oxidizer having two heat exchangers which is operated continuously and efficiently to clean a process gas.

Regenerative thermal oxidizers are known in the prior art, and are often used to remove impurities or pollutants from an industrial gas stream. In one example, an air stream containing volatile organic compounds such as found in air from a paint spray booth, is directed through a regenerative thermal oxidizer ("RTO"). The RTO removes the impurities from the air stream. In a standard regenerative thermal oxidizer, there are at least two heat exchangers, with a first heat exchanger typically receiving a cool gas to be cleaned, or a "dirty" gas. The other heat exchanger is receiving a hot, clean gas from a combustion chamber.

The dirty gas to be cleaned passes through the first heat exchanger, which is in an inlet mode, and into the combustion chamber. The gas is combusted and cleaned in the combustion chamber. At the same time, gas continuously moves out of the combustion chamber through the second heat exchanger, which is in an outlet mode, and into an outlet passage leading to atmosphere.

The air leaving the combustion chamber is quite hot, and it heats the second heat exchanger. At the same time, the dirty gas passing through the first heat exchanger is relatively cool, and it cools the first heat exchanger. After a period of time, valves associated with the two heat exchangers are switched such that the first heat exchanger, which had previously received the cool, dirty gas, is switched to receiving the hot, clean gas. The second heat exchanger which had been receiving the hot, clean gas is switched to receiving the dirty, cool gas. The dirty, cool gas now passes over the previously heated heat exchanger and is preheated prior to reaching the combustion chamber. The preheating improves the efficiency of the system. At the same time, the heat exchanger which had been previously receiving the cool, dirty gas, and which has been cooled by that gas, is now again heated by the hot, clean gas. This cyclical process is repeated as the RTO continuously and efficiently removes impurities from a high volume industrial gas stream.

One problem encountered with RTO systems is that since the outlet passage is typically directed back to atmosphere, strict controls are necessary to insure that no "dirty" gas reaches the atmosphere. When a heat exchanger is initially switched from being in an inlet mode where it receives dirty gas, to being in an outlet mode where it receives clean gas, there may be some residual dirty gas remaining in the heat exchanger.

To address this problem, RTO's have often been provided with a third heat exchanger. The third heat exchanger is operated in a purge mode to drive any residual dirty gas from the heat exchanger, prior to that heat exchanger moving to an outlet mode. Purge modes are typically included on RTO systems having three or more heat exchangers.

In some cases it might be desirable to have an RTO system with only two heat exchangers. The purge function would still be desirable to minimize the flow of dirty gas to atmosphere. It has typically been believed that a break in flow of gas from the source of dirty gas is necessary during the time the purge drives residual air from the heat exchanger in a two heat exchanger RTO system. It is a goal of any RTO system to maximize the volume of gas that is cleaned. Providing a break between the inlet and outlet modes undesirably decreases the efficiency. Also, it is desirable to continue to process dirty gas continuously and move the dirty gas from the industrial source of dirty gas to the RTO continuously.

Thus, there has been some effort to develop an RTO system wherein two heat exchangers are provided with a purge function. One example is shown in the PCT International Patent Publication No. WO91/00477. In this disclosure, a single rotary valve alternately connects two heat exchangers between an inlet and an outlet passage. The inlet passage is alternately connected to the dirty gas, or to a clean purging gas. The single rotary valve must fully separate the inlet and outlet passages. The operation of this system is such that the single rotary valve would have to be controlled extremely accurately to prevent the communication of dirty gas with the outlet passage. Even with careful control, leakage of dirty gas to the outlet is a possibility. As such, this proposed system does not achieve all of the goals for a two heat exchanger RTO system.

SUMMARY OF THE INVENTION

In a disclosed embodiment of this invention, an RTO system is provided with two heat exchangers. An inlet manifold communicates with an inlet passage leading to each heat exchanger, and an inlet valve is placed in each inlet passage. An outlet manifold communicates with an outlet passage leading to each heat exchanger, and an outlet valve is placed in each outlet passage. A purge chamber is selectively communicated with the inlet manifold. The purge chamber is connected through purge passages to the heat exchangers. Purge valves are incorporated in each purge passage. A purge backflow valve is provided on the purge chamber, and allows communication of clean gas, such as from the atmosphere, to the purge chamber. The provision of the separate inlet, outlet and purge valves on the inventive two heat exchanger system allows the operator to continuously and efficiently operate the two heat exchanger RTO system. At the same time, the use of the separate valves allow easy control of the reversal of each heat exchanger between its inlet, outlet and purge modes, without the risk of inadvertently communicating dirty gas to atmosphere.

In a method of operating a heat exchanger according to this invention, the purge chamber is connected through its back valve to atmosphere to fill the purge chamber with clean gas. At the same time one of the two chambers is in its inlet mode. The purge back valve is closed once the purge chamber is full. At some time after closure of the back valve, the time comes to reverse the flow of inlet and outlet gas between the two heat exchangers.

Initially, the inlet valve on the first heat exchanger that was previously receiving dirty gas is closed. The outlet valve on the second heat exchanger remains open. The purge valve on the first heat exchanger is then open. The clean gas from the purge chamber is then driven through the first heat exchanger, driving any residual dirty gas from the first heat exchanger into the combustion chamber.

The purge chamber is preferably connected to the inlet manifold, and gas in the inlet manifold drives the clean gas from the purge chamber through the first heat exchanger with the open purge valve. Thus, the dirty gas moves through the purge chamber, and approaches the open purge valve. Since the clean purge gas is driven by the continuous flow of dirty gas from the inlet manifold, the purge cycle does not stop the flow of dirty gas to the RTO system. Prior to the dirty gas reaching the open purge valve, the purge valve is closed. Thus, no dirty gas will reach the heat exchanger during the purge mode, or through the purge valve.

At the same time, the outlet valve on the first heat exchanger can begin to be open during the end of the purge mode. The purge cycle thus preferably takes part at least during a portion of the time that the outlet valve on the first heat exchanger is initially opening. The opening of the outlet would otherwise be dead time, and thus, the use of the purge cycle does not decrease the efficiency of the system. Rather, a good portion of the purge cycle occurs during the time when the outlet valve is opening. Since the outlet valve is not opened until well into the purge cycle, only clean purge gas should be in the heat exchanger when the outlet valve begins to open. Thus, there is little danger of dirty gas moving through the open outlet valve. In fact, the volume of the purge chamber can be designed to provide adequate purge gas to allow this opening. Soon after the outlet valve is fully open, the purge valve is shut. Timing of the valve openings must be selected such that the purge valve is shut prior to the dirty gas extending through the purge chamber and reaching the open purge valve. At the time the outlet valve begins to open on first heat exchanger, the outlet valve on the second heat exchanger may remain open. Also, the inlet valves are closed as an associated purge valve begins to open. Again, valve opening time is incorporated into the purge cycle, decreasing the dead time between the inlet and outlet modes. In this way, the present invention maximizes the efficiency of a two heat exchanger RTO system, while still insuring a complete and adequate purging of residual dirty gas from a heat exchanger prior to that heat exchanger moving to an outlet mode.

These and other features of the present invention can be best understood from the following specification and drawings, of which the following is a brief description.

DETAILED DESCRIPTION OF A PREFERRED EMBODIMENT

Figure 1:
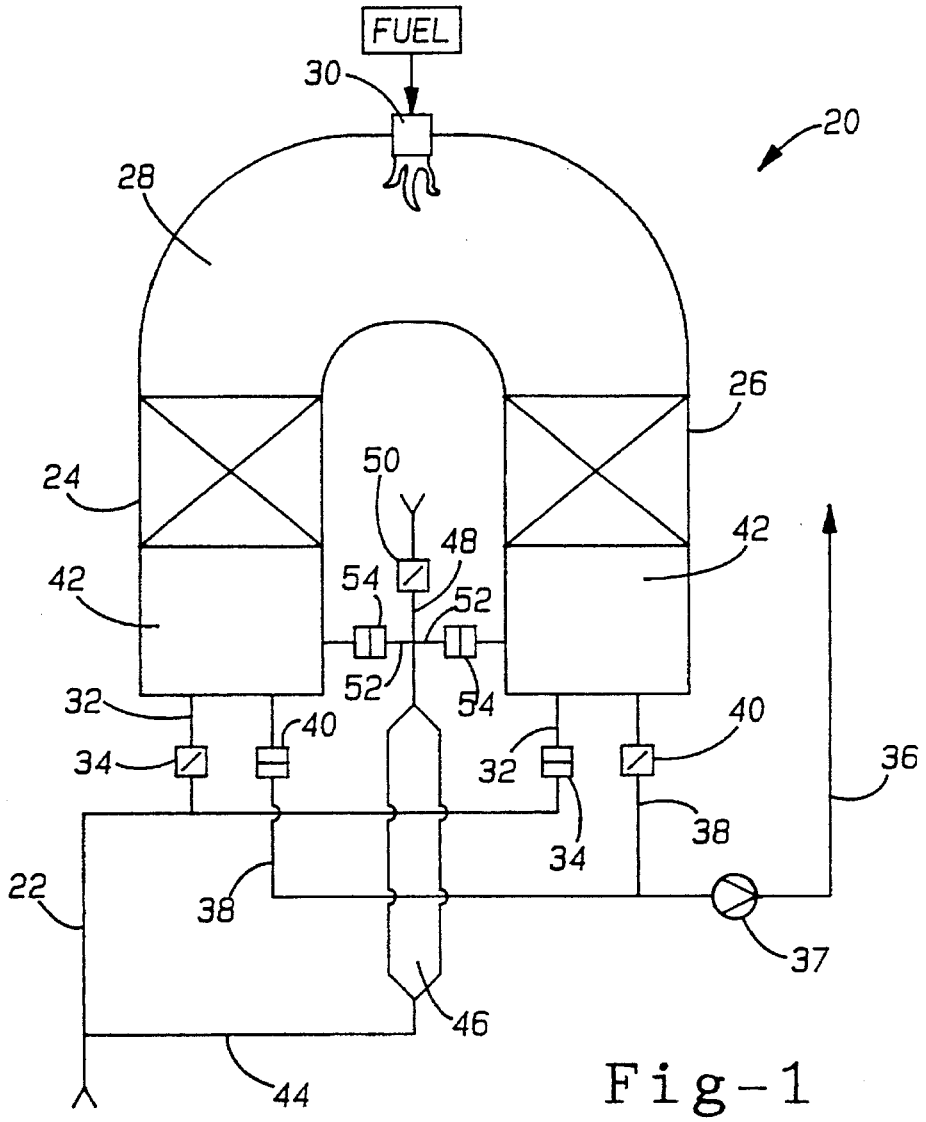
FIG. 1 is a highly schematic view of a two heat exchanger RTO system.

FIG. 1 shows a two heat exchanger RTO system 20 including inlet manifold 22 connected to a source of dirty gas to be cleaned. Inlet manifold 22 provides gas to be cleaned to a pair of heat exchangers 24 and 26. Heat exchangers 24 and 26 communicate with a combustion chamber 28 which includes a burner 30. The inlet manifold 22 communicates with an inlet passage 32 extending through an inlet valve 34 to each of the heat exchangers 24 and 26. An outlet manifold 36 includes a fan 37 to assist in drawing clean gas from outlet passages 38 associated with each of the heat exchangers 24 and 26, and through an outlet valve 40 received on each passage 38. An area 42 beneath the heat exchangers communicates with both passages 32 and 38. As shown, a jumper passage 44 communicates a purge chamber 46 to the inlet manifold 22. Purge chamber 46 communicates with a purge fill passage 48 extending through a back purge valve 50. Back purge valve 50 selectively connects passage 48 to a source of clean gas, such as the atmosphere. Passage 48 also communicates with purge passages 52. Purge passages 52 receive purge valves 54 to control communication with the area 42 associated with each of the heat exchangers 24 and 26. The operation of the inventive two heat exchanger RTO system 20 will now be explained with reference to FIGS. 2–11.

Figure 2:
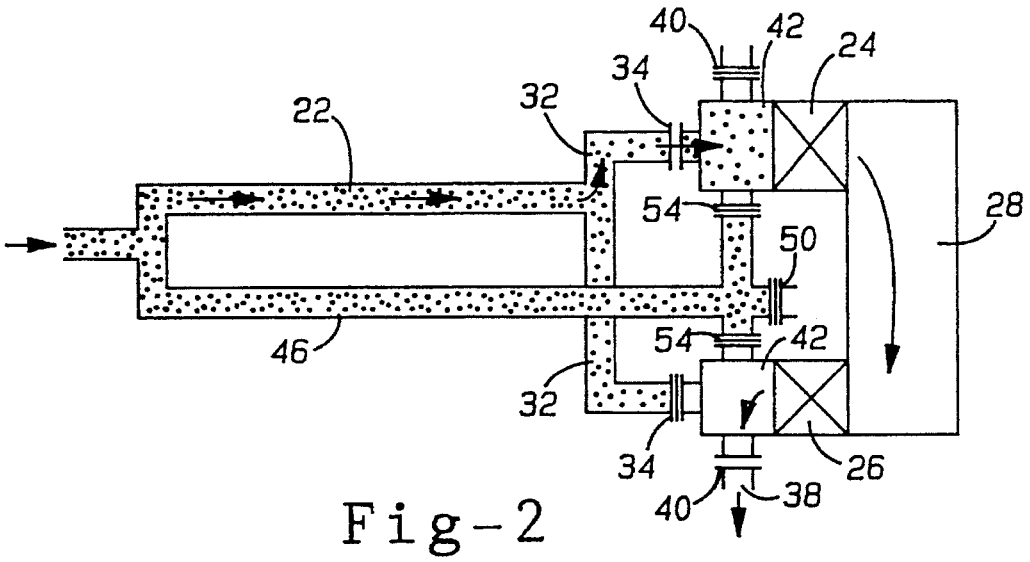
FIG. 2 is a schematic view showing a two heat exchanger RTO system in a first portion of its operating cycle.

As shown in FIG. 2, heat exchanger 24 is in an inlet mode, and heat exchanger 26 is in an outlet mode. To this end, the inlet valve 34 of heat exchanger 24 is open and the outlet valve 40 associated with heat exchanger 26 is also open. The inlet valve 34 associated with heat exchanger 26, and the outlet valve 40 associated with heat exchanger 24 are closed. At the same time, the back purge valve 50 and the two purge valves 54 are all closed. As shown, the purge chamber 46 is filled with a dirty gas. In FIGS. 2–10, the dirty gas is shown by having markings or dots in the flow, while a clean gas is shown as a lack of such markings.

Figure 3:
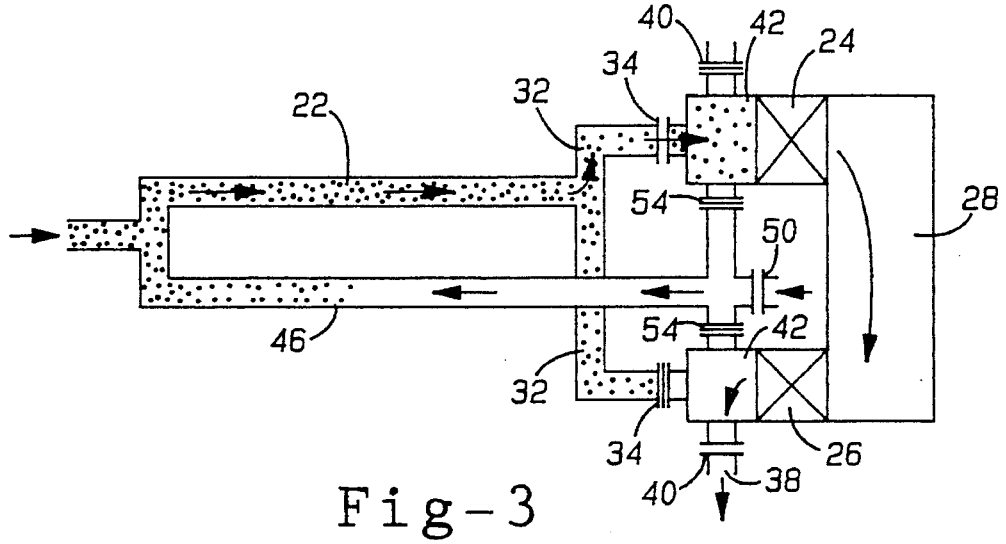
FIG. 3 shows a subsequent step in the operating cycle.

FIG. 3 shows the first step in beginning the purge cycle to switch the heat exchangers 24 and 26 between inlet and outlet modes. As shown, the process continues identically as in FIG. 2, however, the back purge valve 50 is now open. There is no danger of dirty gas leaving purge chamber 46 outwardly through back purge valve 50, since there is a negative pressure on the inlet manifold 22 due to the open inlet valve 34. As such, the dirty gas in purge chamber 46 is now driven out of purge chamber 46, into the inlet manifold 22, through the inlet passage 32, and into the heat exchanger 24. The dirty gas in purge chamber 46 is replaced by clean gas from passage 48 associated with back purge valve 50.

Figure 4:
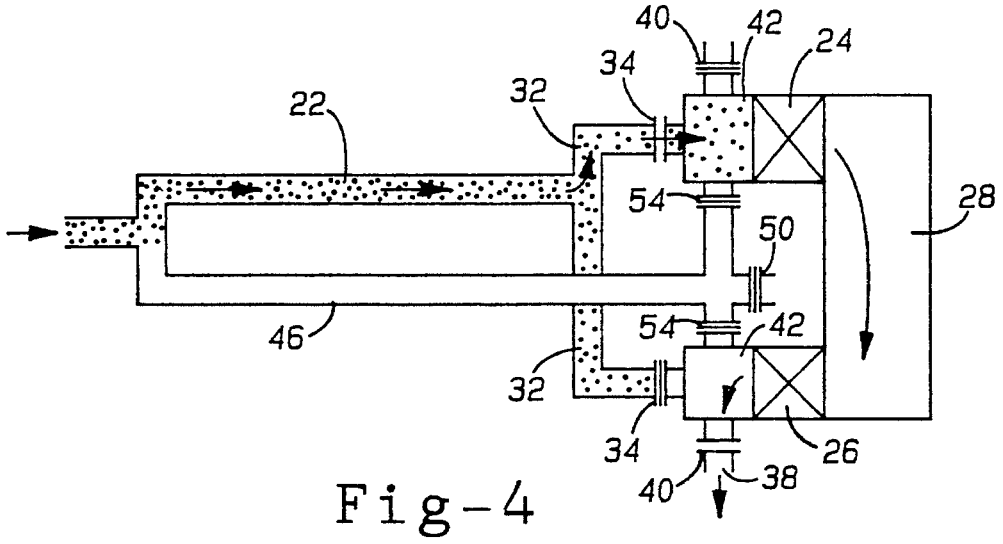
FIG. 4 shows yet another subsequent step in the operating cycle.

As shown in FIG. 4, once purge chamber 46 is full of clean gas, valve 50 is closed. The process continues, with heat exchanger 24 continuing in the inlet mode, and heat exchanger 26 continuing in the outlet mode.

Figure 5:
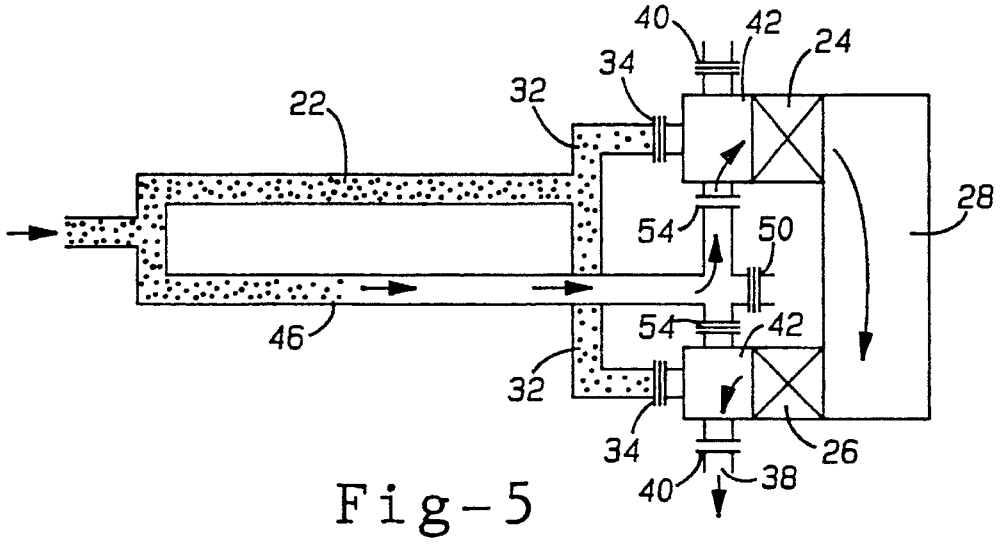
FIG. 5 shows yet another subsequent step in the operating cycle.

As shown in FIG. 5, inlet valve 34 associated with heat exchanger 24 is now closed. At the same time, outlet valve 40 associated with heat exchanger 26 remains open. The purge valve 54 associated with heat exchanger 24 is now opened, and the clean gas in purge chamber 26 is driven through the space 42 below the heat exchanger 24, driving any residual dirty gas into the combustion chamber 28. As can be seen, as the purge chamber 26 drives clean gas through purge valve 54, the dirty gas begins to fill the purge chamber 26 behind the clean gas. Thus gas does still flow continuously from the inlet manifold 22. Prior to the time that the dirty gas reaches the valve 54, valve 54 is closed. The selection of the valve timing required to achieve this closure is well within the ability of a worker of ordinary skill in the art.

Figure 6:
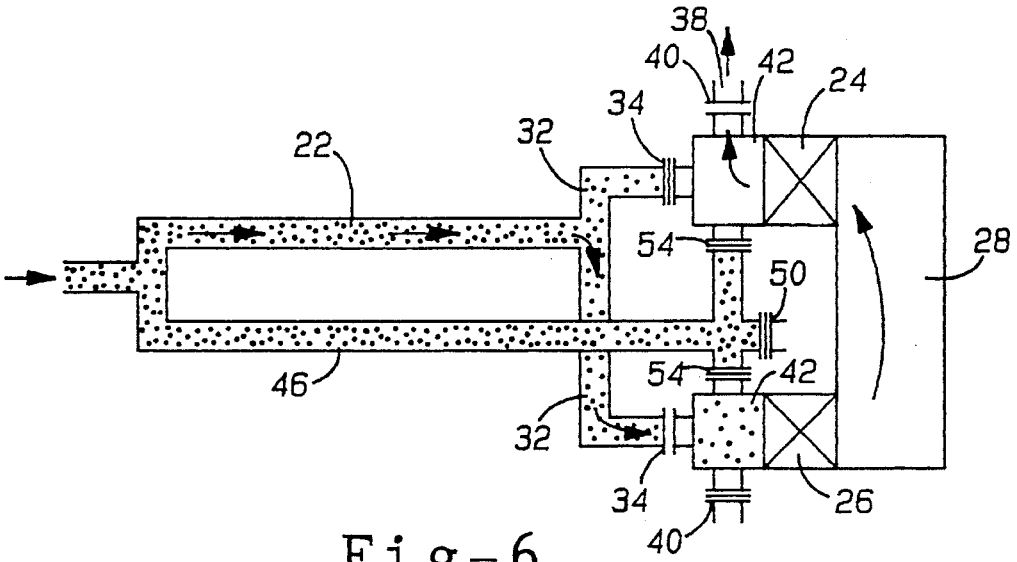
FIG. 6 shows yet another subsequent step in the operating cycle.

As shown in FIG. 6, purge valve 54 is closed. Once the purge cycle has driven the residual dirty gas from the space 42 beneath heat exchanger 24, the outlet valve 40 associated with heat exchanger 24 may be opened. At the same time, the outlet valve 40 associated with heat exchanger 26 is closed, and the inlet valve 34 associated with heat exchanger 26 is open. The RTO system is now operating with the heat exchanger 26 in an inlet mode, and heat exchanger 24 in an outlet mode. Due to the use of the separate purge valves, the system insures that no dirty gas will be in space 42 associated with heat exchanger 24 when heat exchanger 24 is initially switched to its outlet mode.

Moreover, once the purge cycle has begun, and has driven the residual dirty gas from the space 42, there is preferably additional clean purge gas in chamber 46. It is thus possible to begin to open the outlet valve 40 on heat exchanger 24 while the purge cycle is still ongoing. Thus, the outlet valve opening time, which in the prior art is dead time, can now occur during a portion of the purge cycle. The operator can be relatively confident that the initial portion of the purge cycle will have driven the residual dirty gas from the space 42 into the combustion chamber 28, and that there is little possibility that there will be any remaining dirty gas in the space 42 as the outlet valve 40 begins to open. By the time the outlet valve 40 is fully open, the purge valve 54 is closed, and the process will resemble that shown in FIG. 6.

Figure 7:
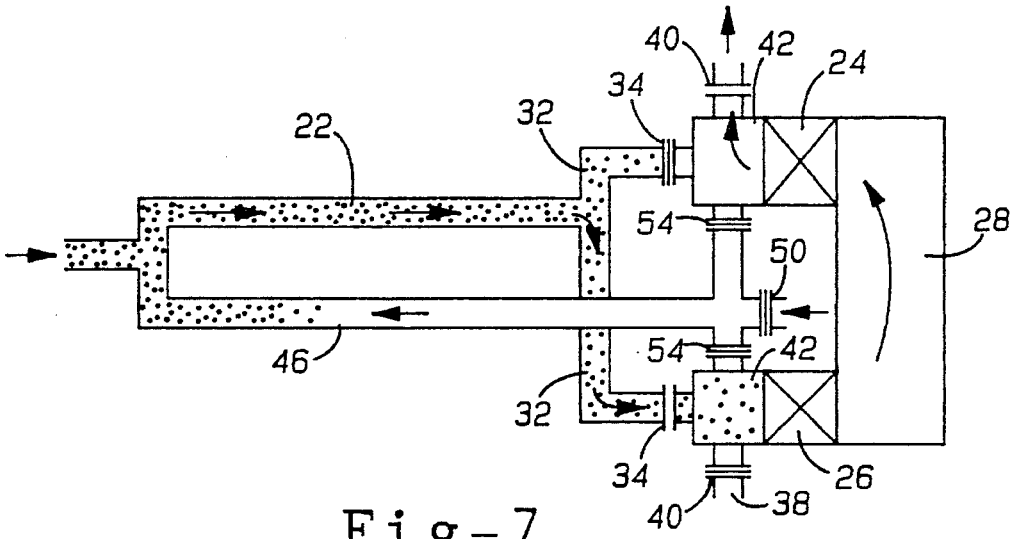
FIG. 7 shows yet another subsequent step in the operating cycle.

FIG. 7 shows a point in the operation similar to that shown in FIG. 3. The purge chamber 26 is again being refilled with clean air.

Figure 8:
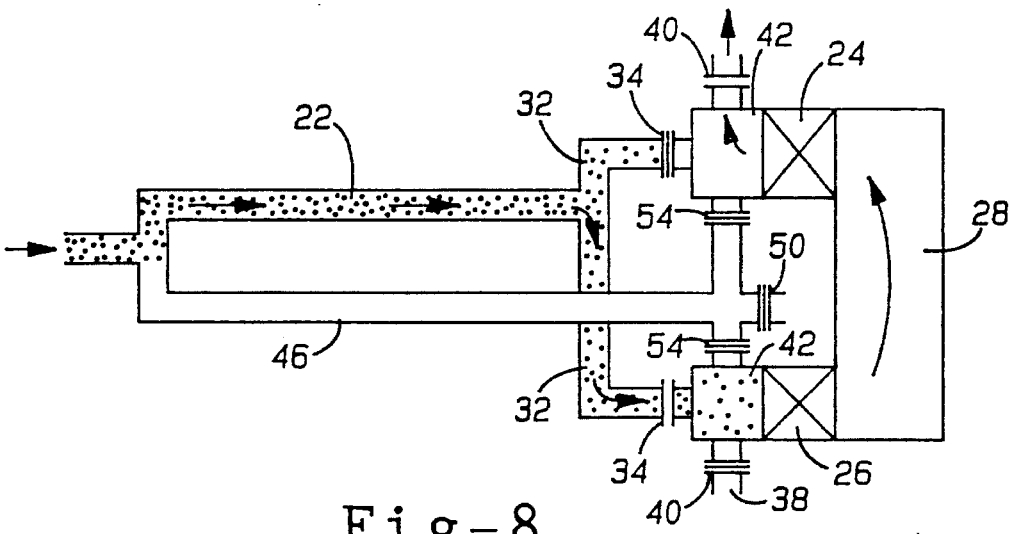
FIG. 8 shows yet another subsequent step in the operating cycle.

FIG. 8 shows a point in the operation similar to that shown in FIG. 4. The operation continues with heat exchanger 24 in the outlet mode and heat exchanger 26 in the inlet mode.

Figure 9:
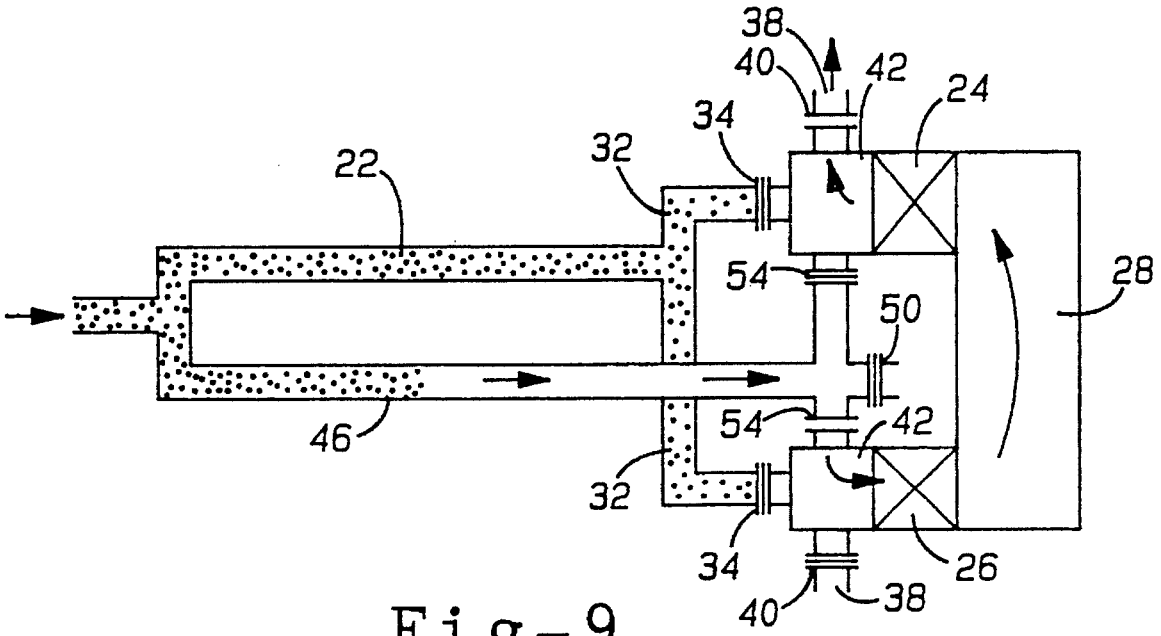
FIG. 9 shows yet another subsequent step in the operating cycle.

FIG. 9 shows a point in operation similar to that shown in FIG. 5. Purge gas is driving any residual dirty gas remaining in heat exchanger 26.

Figure 10:
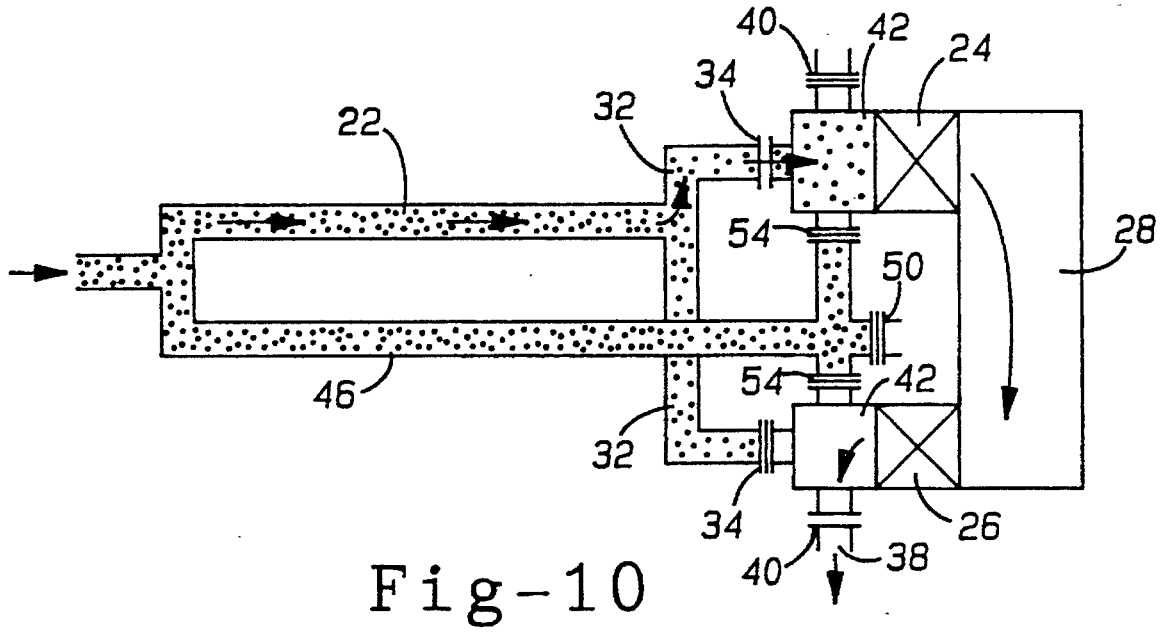
FIG. 10 shows the RTO system having returned to the condition shown in FIG. 2.

FIG. 10 shows the system having returned to the point shown in FIG. 2. Again, due to the unique arrangement of the purge chamber 26 and the purge valves 50 and 54, the operation of the two heat exchanger RTO system can continue efficiently, while still insuring that no dirty gas will reach the outlet manifold.

Figure 11:
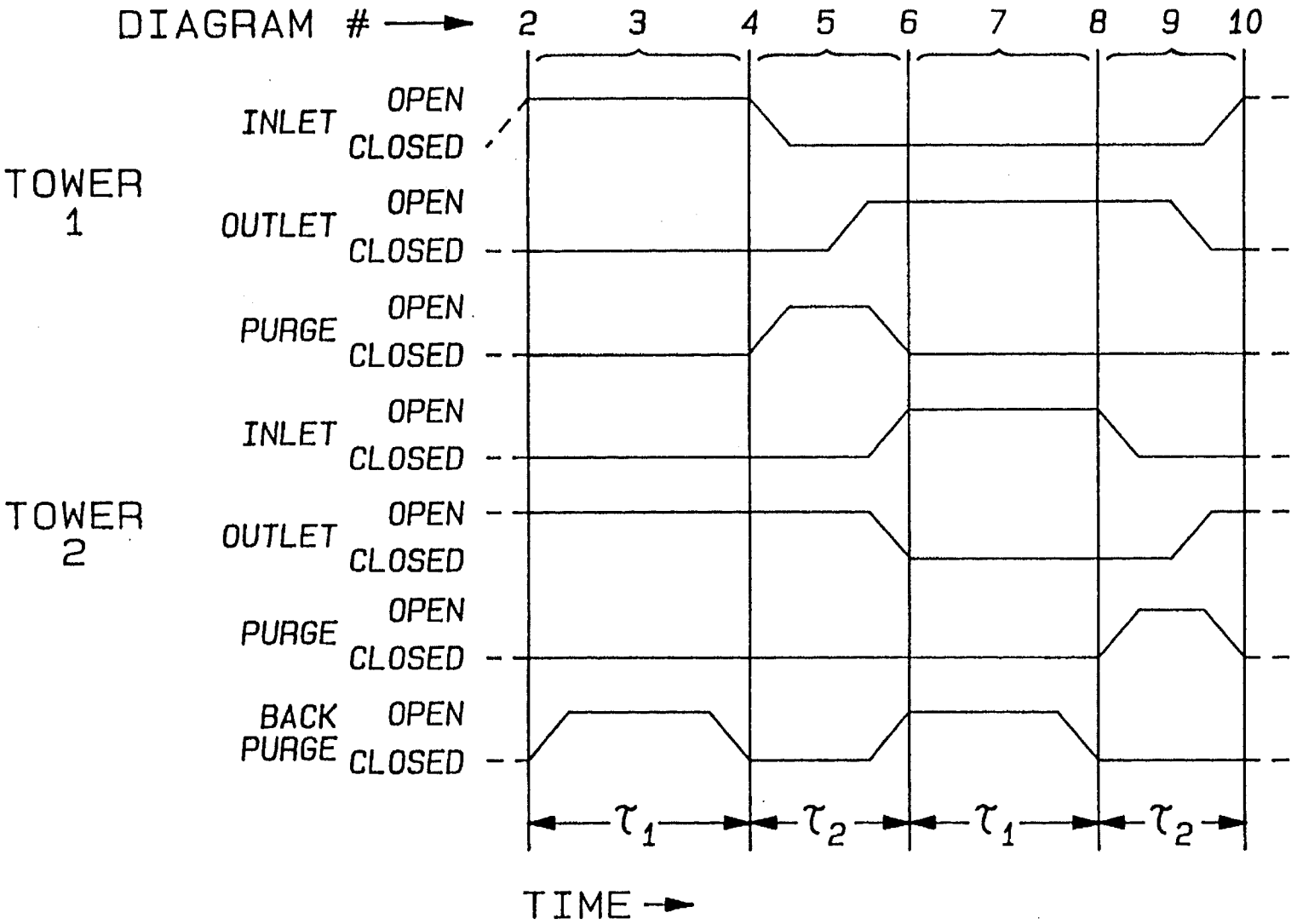
FIG. 11 is a valve timing diagram showing the opening and closing of the inlet, outlet and purge valves for the two heat exchangers according to this invention.

FIG. 11 is a valve timing diagram showing the opening and closing of the inlet outlet and purge valves, 34, 50 and 54, respectively. The figure numbers 2–10 corresponding to the figures of this application are shown for each of the periods shown in FIG. 11 placed near the top of the figure. As can be seen, in FIG. 5, while the purge valve remains open, the outlet valve on the first heat exchanger 24 can begin to be open. Thus, this valve opening time, which in the prior art was essentially dead time, can be accomplished while completing the purge function. Also, as the first outlet valve is opening, the other outlet valve remains open. The other outlet valve only begins to close once the first outlet valve is fully open. The purge chamber gas allows this continuous operation. A similar occurrence can be seen with regard to the second heat exchanger 26 during the time shown at FIG. 9. Further, since it is dirty gas which drives the purge gas out of the purge chamber, gas still flows continuously through the inlet manifold, even though all inlet valves are closed.

Figure 12:
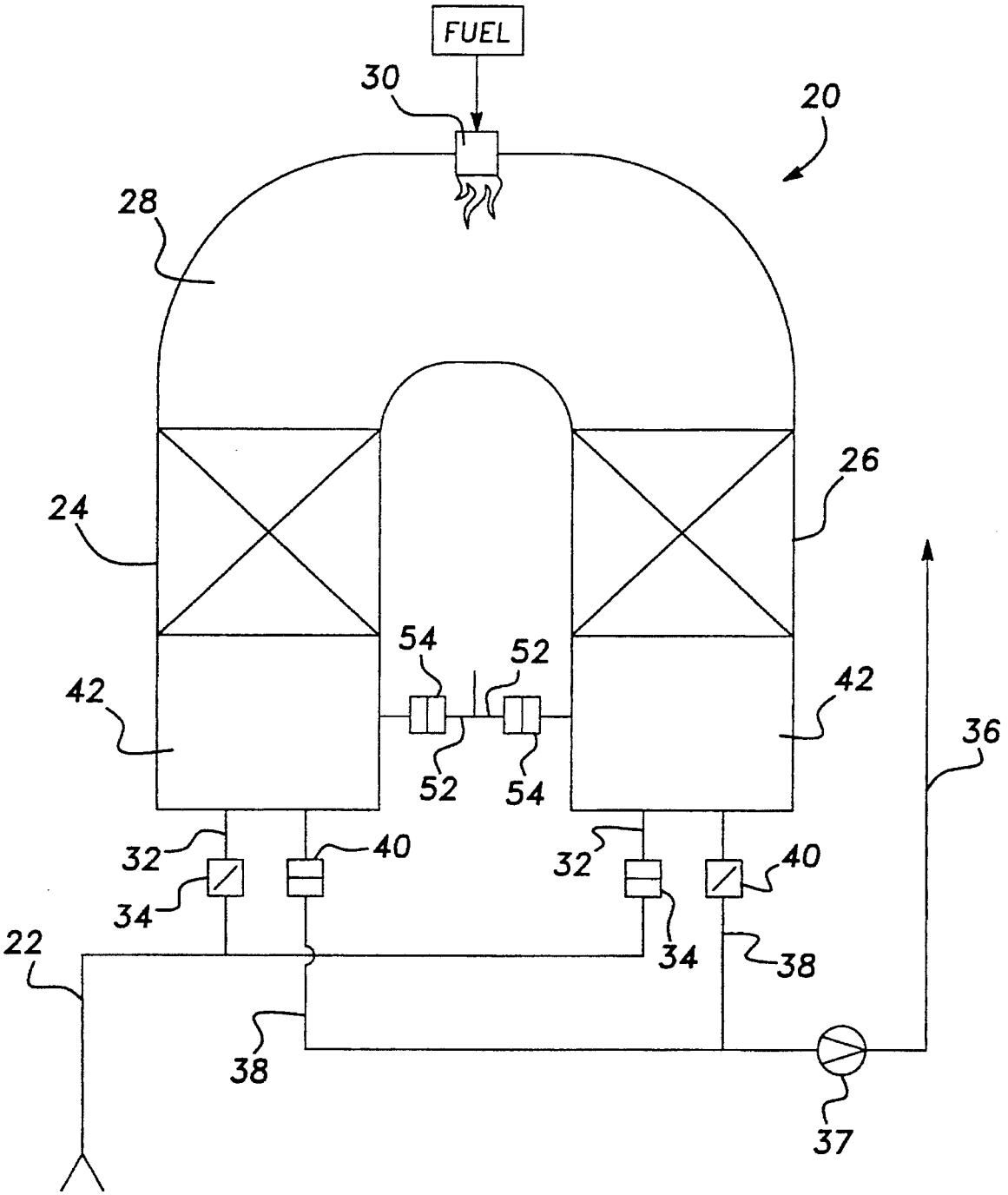
FIG. 12 shows an alternative RTO system.

FIG. 12 shows an alternative system in which the purge chamber is eliminated. Rather than store purge gas in a chamber, the clean purge gas moves through one of the valves 54. When purge gas is delivered through an open purge valve, both inlet valves 34 are closed, and the outlet valve 40 on the heat exchanger, which is not in a purge mode, is opened. This system may be practical in an operation that can withstand short interruptions in process gas flow in the inlet manifold.

In summary, the present invention discloses an efficient, effective, and relatively safe method of achieving continuous processing of dirty gas using a two heat exchanger RTO system. The present invention is a simplified system, and relatively more foolproof than the prior art. As such, the present invention contributes valuable benefits to the field of regenerative thermal oxidizers.

A preferred embodiment of this invention has been disclosed. However, a worker of ordinary skill in the art would recognize that certain modifications come within the scope of this invention. For that reason, the following claims should be studied to determine the true scope and content of this invention.

I claim:

1. A regenerative thermal oxidizer comprising:

a first and a second heat exchanger communicating with a common combustion area;

an inlet manifold communicating with a source of gas to be cleaned, said inlet manifold communicating with an inlet passage leading to each of said first and second heat exchangers, each of said inlet passages including a selectively open inlet valve;

an outlet manifold communicating with an outlet passage leading to each of said first and second heat exchangers, and an outlet valve received in each of said outlet passages; and a purge chamber, said purge chamber communicating with said inlet manifold such that a portion of the gas to be cleaned is allowed to enter said purge chamber, said purge chamber communicating with purge passages leading to each of said first and second heat exchangers, and a purge valve received in each of said purge passages to allow flow of a clean purge gas from said purge chamber and into said heat exchangers.

2. A regenerative thermal oxidizer as recited in claim 1, wherein said purge chamber communicates to atmosphere through a selectively opened back valve.

3. A regenerative thermal oxidizer as recited in claim 2, wherein said back valve is connected to a T-connection between said two purge passages.

4. A regenerative thermal oxidizer as recited in claim 3, wherein said connection of said purge chamber to atmosphere is at an opposed end of said purge chamber from said communication of said purge chamber to said inlet manifold.

5. A method of operating a regenerative thermal oxidizer comprising the steps of:

(i) providing a pair of heat exchangers, each of said heat exchangers communicating with a combustion area;

(ii) providing an inlet manifold communicating with a source of gas to be cleaned, and providing inlet passages leading from said inlet manifold to both of said first and second heat exchangers;

(iii) providing an outlet manifold leading from said heat exchangers, and providing outlet passages leading from each of said first and second heat exchangers to said outlet manifold;

(iv) providing inlet valves in each of said inlet passages and outlet valves in each of said outlet passages;

(v) providing a purge chamber communicating with said inlet manifold at one end, and providing a purge passage communicating said purge chamber to each of said first and second heat exchangers, and providing purge valves on each of said purge passages;

(vi) providing a source of relatively clean air to said purge chamber, closing an inlet valve and an outlet valve associated with said first heat exchanger, and opening said purge valve associated with said first heat exchanger, driving said clean air received in said purge chamber through said first heat exchanger, using said source of gas to be cleaned, to drive any residual dirty gas from said first heat exchanger, while maintaining an outlet valve associated with said second heat exchanger open such that said second heat exchanger remains in an outlet mode; and (vii) closing said purge valve associated with said first heat exchanger, opening said outlet valve associated with said first heat exchanger, closing said outlet valve associated with said second heat exchanger, and opening said inlet valve associated with said second heat exchanger.

6. A method as recited in claim 5, wherein the method further includes the step of providing a back purge valve selectively communicating said purge chamber to atmosphere, said back purge valve being opened to supply said source of clean gas to said purge chamber.

7. A method as recited in claim 6, wherein said back purge valve is closed prior to said purge valve being opened in Step (vi).

8. A method as recited in claim 5, wherein said outlet valve associated with said first heat exchanger is opened prior to said purge valve being closed in Step (vii).

9. A regenerative thermal oxidizer comprising:

only two heat exchangers, each communicating with a common combustion chamber;

an inlet manifold communicating with a source of gas to be cleaned, said inlet manifold communicating with an inlet passage leading to each of said two heat exchangers, each of said inlet passages including a selectively open inlet valve;

an outlet manifold communicating with an outlet passage leading to each of said two heat exchangers, and an outlet valve received in each of said outlet passages;

purge passages leading to each of said two heat exchangers, a purge valve received in each of said purge passages to allow flow of a clean purge gas from a source of purge gas into each of said two heat exchangers; and a purge chamber for supplying the clean purge gas to said two heat exchangers, said purge chamber being in communication with said inlet manifold, such that a portion of the gas to be cleaned enters into said purge chamber.

* * * * *